United States Patent [19]

Morrone, III

[11] 4,429,557

[45] Feb. 7, 1984

[54] KEY HOLDER

[75] Inventor: Joseph A. Morrone, III, Westerly, R.I.

[73] Assignee: Adecon, Inc., Warwick, R.I.

[21] Appl. No.: 333,667

[22] Filed: Dec. 23, 1981

[51] Int. Cl.[3] ..... A47G 29/10

[52] U.S. Cl. ..... 70/456 R; 70/459

[58] Field of Search ..... 70/456 R, 456 B, 457, 70/458, 459; 24/3 K, 230.5 R, 230.5 AD

[56] References Cited

U.S. PATENT DOCUMENTS 438,097 10/1890 Colton ..... 70/456 R 4,309,883 1/1982 Brentini ..... 70/456 R

FOREIGN PATENT DOCUMENTS 1482475 4/1967 France ..... 70/459

*Primary Examiner*—Robert L. Wolfe

*Attorney, Agent, or Firm*—Salter & Michaelson

[57] ABSTRACT

A holder for keys and the like comprising a pair of plates which are disposed in abutting relation and which have aligned openings therethrough. The openings are defined by peripheral bars on the plates which have passages therethrough which are normally disposed in nonaligned relation. The plates are slidable relative to each other to move the passages into registry so that a key or the like may be positioned on the bars. The plates are thereafter returnable to their normal positions to secure the key on the holder.

12 Claims, 8 Drawing Figures

KEY HOLDER

BACKGROUND AND SUMMARY OF THE INVENTION

The instant invention relates to a novel construction for a holder for keys and the like.

The holder comprises a pair of substantially flat preferably identical plates, each having an opening therethrough with a transverse peripheral bar defining an end of said opening, and each bar having a passage extending therethrough. The plates are normally disposed in slidable abutting relation with the openings thereof in substantially aligned relation and with the bars thereof at least partially coextensive but with the passages in the bars normally in nonaligned relation. The plates are relatively slidable to an open position of the holder wherein the passages in the bars are in aligned relation whereby a key or the like is positionable on the bars. The plates are thereafter movable to the closed position hereinabove described wherein the passages are in nonaligned relation whereby the key or the like is retained on the bars.

Retaining the plates in slidable abutting relation are resilient tongue members which preferably are integrally formed on the plates and which cooperate with each other as hereinafter more fully described to maintain the plates in assembled relation while at the same time permitting the plates to move relative to each other to define the open and closed positions of the holder.

While holders for keys and the like have heretofore been available in various configurations wherein one member is movable with respect to another member to open or close an opening so that keys may be inserted or removed from the holder, the instant invention differs significantly from such prior art. The two plates with their respective tongue members are preferably of identical configuration so that they can be made from the same mold for simplicity in manufacturing. The plates are normally retained in the closed position of the holder by interlocking of the tongue members to prevent accidental removal of the keys from the holder. The plates are easily movable to the open position, however, by grasping the plates between the thumb and the forefinger and exerting a sliding force thereto to move the passages on the plates into registry whereupon keys or the like may be inserted onto or removed from the holder. The exertion of a similar but opposite sliding force thereafter moves the plates to their closed positions.

Accordingly, it is an object of the instant invention to provide a holder for keys and the like wherein a pair of identical interlocking slidable plates are alternatively slidable between open and closed positions to permit insertion of keys onto or removal of keys from the holder.

Another object of the instant invention is to provide a holder for keys and the like wherein a pair of substantially flat plates are slidably retained in abutting relation by means of integrally formed interlocking tongue members whereby no extra fastening means are required to effect assembly of the plates.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
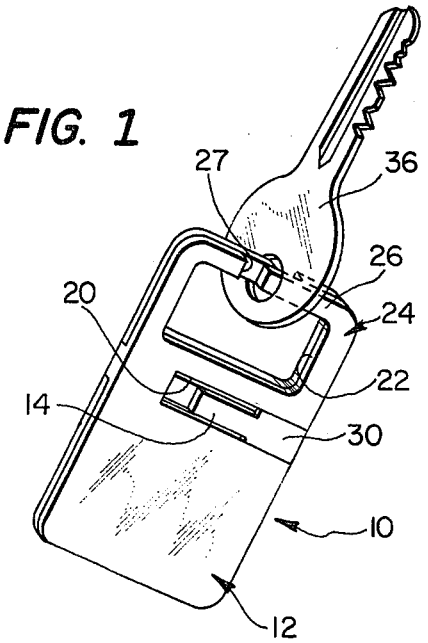
FIG. 1 is a perspective view of the key holder of the instant invention in the closed position with a key thereon.
Figure 2:
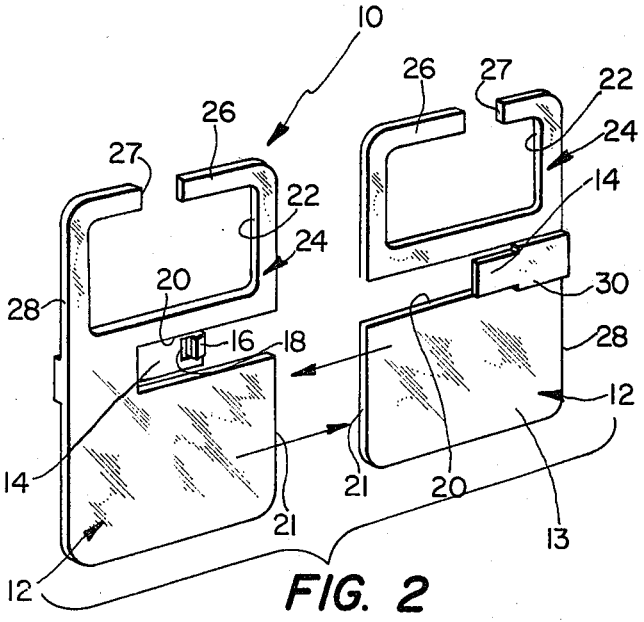
FIG. 2 is an exploded perspective view of the holder.

Referring now to the drawing, the holder of the instant invention is generally indicated at 10 in FIGS. 1 through 8. The holder 10 generally comprises a pair of plates 12, having substantially flat inner surfaces 13 which are disposed in slidable abutting relation, a pair of integrally formed resilient tongue members 14 which are attached to the plates 12 and cooperate to retain said plates in abutting relation, and interlocking teeth 16 and notches 18 on said tongue members which cooperate as detents to releasably retain the plates 12 in their closed positions.

The plates 12 may be made of any suitable rigid material and may be embodied in various configurations. Preferably, however, the plates 12 are molded of a rigid plastic material such as acrylic, polycarbonate, styrene or polypropylene in a generally rectangular configuration. Generally rectangular slots 20 extend transversely inwardly from first vertical edges 21 of the plates 12 and extend to a point somewhat more than halfway across the plates. Substantially rectangular openings 22 are provided adjacent the upper ends of the plates to define peripheral rings 24 thereon which include substantially transverse upper bars 26 having passages 27 therethrough which are offset from the longitudinal centerline of their respective plates 12 away from the edges 21 thereof.

The tongue members 14 are secured to their respective plates 12 in slightly outwardly offset relation to the planes of the surfaces 13 thereof extending from second vertical edges 28 of the plates 12 which are opposite from the edges 21 in alignment with and partially overlying the respective slots 20 of the plates 12. The tongue members 14 are formed integrally with enlarged slide portions 30 which are dimensioned to be slidingly received in the slot 20 of the opposite plate 12. The slide portions 30 extend generally transversely inwardly from the edges 28 to the inner ends of the slots 20 and the tongue members 14 extend inwardly therefrom to a point slightly beyond the longitudinal centerline of the plate. The teeth 16, which include outwardly bevelled edges 34 are formed on the inner sides of the tongue members 14 adjacent the terminal ends thereof and the notches 18 are disposed just inwardly of the teeth 16.

Figure 3:
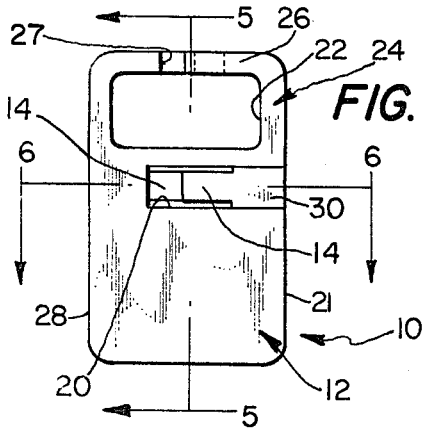
FIG. 3 is a side elevational view of the holder in the closed position.
Figure 5:
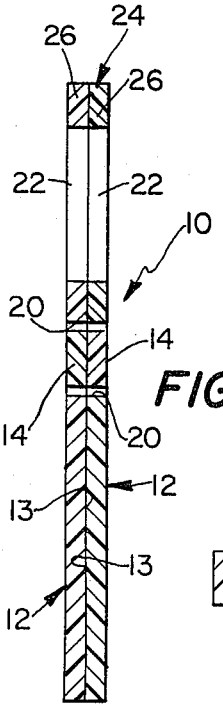
FIG. 5 is an enlarged sectional view taken along line 5—5 in FIG. 3.
Figure 4:
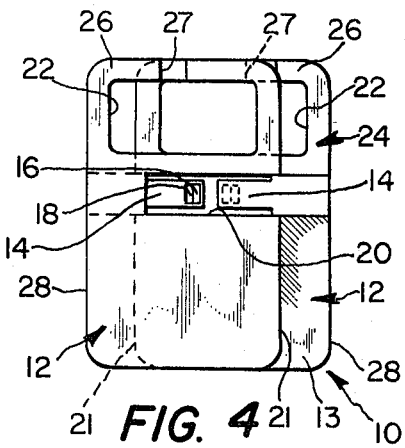
FIG. 4 is a side elevational view illustrating the position of the plates just prior to assembly.
Figure 6:
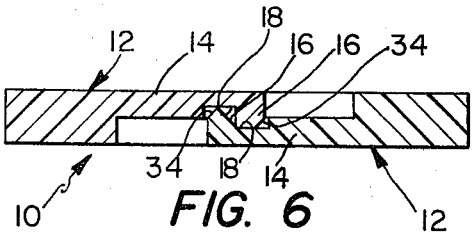
FIG. 6 is an enlarged sectional view taken along line 6—6 in FIG. 3.

The plates 12 are assembled by positioning them in partially overlapping relation with the surfaces 13 in abutting relation and with the tongue members 14 in the slot 20 of the opposite plate 12, as illustrated in FIG. 4. As the plates 12 are moved toward the aligned or assembled position of FIGS. 1 and 3, the slide portions 30 are advanced in the slot 20 of the opposite plate 12 and the bevelled edges 34 of the opposite teeth 16 move into engagement with each other. Further relative sliding movement of the plates 12 causes outward bending of the tongue members 14 permitting overriding of the teeth 16 into interlocking relation in the notches 18 in the opposite tongue members 14 to define the closed position of the holder 10, as illustrated in FIGS. 1, 3 and 6 wherein the plates 12 are in substantially aligned overlapping relation. As is seen particularly from FIG. 6, relative sliding movement of the plates 12 to thereafter effect the separation thereof is prevented by the interlocking relation of the teeth 16 in the notches 18.

Figure 7:
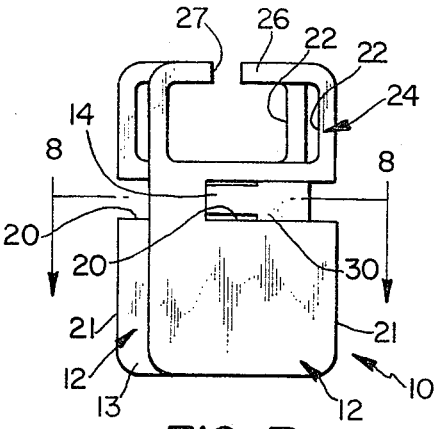
FIG. 7 is a side elevational view of the holder in the open position.
Figure 8:
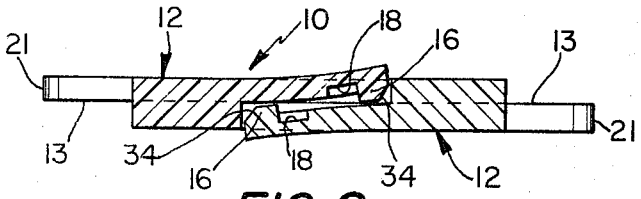
FIG. 8 is an enlarged sectional view thereof taken along line 8—8 in FIG. 7.

While relative sliding movement to separate the plates 12 is prevented by the interlocking relationship of the teeth 16, relative movement of the plates 12 to the open position of the holder 10 illustrated in FIGS. 7 and 8 is nevertheless possible. As will be seen, when a sliding force is applied to the plates 12 to move the tongue members 14 further into the slots 20, the bevelled edges 34 permit passage of the teeth 16 from the notches 18 so that the teeth 16 slide along the inner surfaces of the opposite tongue members 14 until the terminal ends of the teeth 16 engage the ends of the slots 20, as illustrated in FIG. 8, at which point further relative sliding movement of the plates 12 is prevented, it being understood that when the plates 12 are in this position, i.e. the position of FIG. 8, the passages 27 are in registry. Since the passages 27 are offset from the longitudinal centerline of their respective plates 12, when the plates 12 are in their open positions, the plates are in nonaligned relation. However, when the plates 12 are returned to their closed positions, they are moved substantially into alignment and the passages 27 move out of alignment whereby the rings 24 cooperate to provide a closed loop on the holder 10 for retaining keys or the like. As will be noted, when the plates 12 are moved to the aligned or closed position of FIG. 6, the teeth 16 of each plate 12 releaseably snap into the notch 18 of the opposite plate 12 to releaseably latch the plates 12 in their closed and aligned position.

It is seen therefore that the instant invention provides a novel holder for keys and the like. As is illustrated in FIG. 1, one or more keys 36 may be securely retained on the holder 10 when the plates 12 are in their closed or aligned position. The removal or attachment of keys 36 from the holder 10 may be easily effected by grasping the holder 10 between the thumb and forefinger and exerting a sliding action to move the plates 12 to their open or nonaligned position. After the desired keys 36 have been inserted on or removed from the bars 26, the plates 12 are returned to their closed aligned position by the application of a similar but opposite sliding action. Accordingly, because of the simple, effective and unique operation between the plates 12, the holder 10 of the instant invention represents a significant improvement in the art of key holders. In addition, since the plates 12 are of identical construction and are preferably of molded plastic, only a single mold is necessary thereby reducing manufacturing costs. Furthermore, since the plates 12 are asembled by a simple snap-in interengagement of the plates 12, no additional fastening means and no sophisticated assembly operations are required, thus reducing manufacturing costs even further.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A holder for keys and the like comprising a pair of substantially flat plates, and means slidably interconnecting said plates to each other in abutting, face-to-face relation; said plates each having generally aligned ring-like portions, a passage extending through each of said ring-like portions, said plates being relatively slidable between a first position wherein said passages are out of registry and hence access to the interior of said ring-like portions is prevented and a second position wherein said passages are in registry and access to said ring-like portions is permitted, said interconnecting means comprising resilient integrally struck tongue members on each plate, said tongue members resiliently overlapping each other to maintain said plates slidably assembled to each other.

2. In the holder of claim 1, said tongue members having detent means for releaseably maintaining said plates in said first position.

3. In the holder of claim 1, means cooperating with said tongue members for preventing relative sliding movement of said plates beyond said first and second positions.

4. The holder of claim 1, further comprising means for guiding said plates in their relative sliding movement.

5. In the holder of claim 4, said plates having elongated slots therein, said guide means comprising elongated slide members dimensioned to be slidingly received in said slots and traveling in the slots of the opposite plates to thereby guide said plates in their sliding movement.

6. In the holder of claim 5, said slide members extending integrally in aligned relation from said tongue members, said slots extending along the tongue members of their respective plates and a distance therebeyond whereby said tongue members also travel in the slots in the opposite plates.

7. In the holder of claim 1, said plates being of substantially the same configuration.

8. In the holder of claim 1, said plates and their respective tongue members being of unitary construction and made of a rigid plastic material.

9. In the holder of claim 6, the terminal ends of said tongue members engaging the opposite plates in the respective slots thereof at the base of the tongue members of said opposite plates and thereby preventing relative sliding movement of said plates beyond said second position.

10. In the holder of claim 3, said plates having elongated slots therein which extend along the respective tongue members thereof, said tongue members traveling in the slots of the opposite plates with the terminal ends of said tongue members engaging the opposite plates in the respective slots thereof at the bases of the respective tongue members thereof to prevent relative sliding movement of said plates beyond said second position, said tongue members having detent means on the overlapping surfaces thereof which releaseably engage to maintain said plates in said first position and prevent sliding movement thereof beyond said first position.

11. A holder for keys and the like comprising a pair of substantially flat identical plates, and means slidably interconnecting said plates to each other in abutting, face to face relation; said plates each having generally aligned ring-like portions, a passage extending through each of said ring-like portions, said plates being relatively slidable between a first position wherein said passages are out of registry and hence access to the interior of said ring-like portions is prevented and a second position wherein said passages are in registry and access to said ring-like portions is permitted.

12. A holder for keys and the like comprising a pair of substantially flat plates, and means slidably interconnecting said plates to each other in abutting, face-to-face relation for linear sliding movement therebetween; said plates each having generally aligned ring-like portions, a passage extending through each of said ring-like portions, said plates being relatively slidable between a first position wherein said passages are out of registry and hence access to the interior of said ring-like portions is prevented and a second position wherein said passages are in registry and access to said ring-like portions is permitted.

* * * * *